United States Patent [19]

Van Ommeren

[11] Patent Number: 4,940,497

[45] Date of Patent: Jul. 10, 1990

[54] EMULSION EXPLOSIVE COMPOSITION CONTAINING EXPANDED PERLITE

[75] Inventor: Catharine L. Van Ommeren, New Tripoli, Pa.

[73] Assignee: Atlas Powder Company, Dallas, Tex.

[21] Appl. No.: 284,076

[22] Filed: Dec. 14, 1988

[51] Int. Cl.[5] ..... C06B 45/00

[52] U.S. Cl. ..... 149/2; 149/21; 149/46; 149/60; 149/61; 149/76; 149/83

[58] Field of Search ..... 149/2, 21, 46, 60, 61, 149/76, 83

[56] References Cited

U.S. PATENT DOCUMENTS

| | | | |
|---|---|---|---|
| 3,447,978 | 6/1969 | Bluhm | 149/2 |
| 3,715,247 | 2/1973 | Wade | 149/21 |
| 3,765,964 | 10/1973 | Wade | 149/2 |
| 3,770,522 | 11/1973 | Tomic | 149/2 |
| 4,141,767 | 2/1979 | Sudweeks et al. | 149/2 |
| 4,201,606 | 5/1980 | Neat | 149/2 |
| 4,474,628 | 10/1984 | Sudweeks et al. | 149/21 |
| 4,500,370 | 2/1985 | Hajto | 149/2 |
| 4,543,136 | 9/1985 | Edamura et al. | 149/21 |
| 4,756,776 | 7/1988 | Halliday et al. | 149/2 |

FOREIGN PATENT DOCUMENTS 876558 9/1987 South Africa .

*Primary Examiner*—Stephen J. Lechert, Jr.
*Attorney, Agent, or Firm*—Richards, Medlock & Andrews

[57] ABSTRACT

A water-in-oil emulsion explosive composition having a void-providing agent consisting of expanded perlite is provided. The water-in-oil emulsion explosive composition comprising a continuous phase of carbonaceous fuel, an emulsifier, a dispersed phase of an aqueous solution of inorgnaic oxidizer, and expanded perlite having a density of less than 0.60 g/cc and preferably of from about 0.23 g/cc to about 0.45 g/cc.

20 Claims, No Drawings

EMULSION EXPLOSIVE COMPOSITION CONTAINING EXPANDED PERLITE

TECHNICAL FIELD

The present invention relates to a water-in-oil emulsion explosive composition and more particularly relates to a water-in-oil emulsion explosive composition containing a gas-retaining agent, wherein said gas-retaining agent consists of expanded perlite that permits density control upon handling, use, aging, pumping, and shipping, etc.

BACKGROUND OF THE INVENTION

There has been known and used in the explosive industry, slurry explosives which are safer to produce and handle than high explosives. These slurry explosives require chemical or explosive sensitizers to assure detonation and some incorporated gas bubbles.

Subsequently developed were water-in-oil emulsion explosives wherein a discontinuous phase of aqueous solution of inorganic oxidizer salt was dispersed in a continuous phase of carbonaceous fuel. See U.S. Pat. No. 3,447,978.

The above described slurry explosives use chemical or explosive sensitizers, such as monomethylamine nitrate, ethyleneglycol mononitrate, ethanolamine mononitrate, ethylenediamine mononitrate, aluminum powder, PETN, TNT and smokeless powder in order to retain explosive performance. However, the water-in-oil emulsion explosive does not require the use of a chemical or explosive sensitizer. However, the water-in-oil emulsion requires uniformly dispersed void spaces provided by gas bubbles or a void-providing agent to obtain explosive performance. Therefore, maintaining the uniformly dispersed void spaces in the water-in-oil emulsion explosive is important in achieving good detonation performance and good shelf life. Furthermore, the manner in which void spaces are treated may effect the explosive properties of the emulsion explosive.

Void spaces can be provided by gas bubbles which are mechanically or physically mixed or blown into an emulsion explosive. Voids can also be formed in an emulsion explosive by a chemical gassing agent, or mixed into an emulsion explosive by a void-providing agent, such as hollow microspheres, expanded perlite or styrofoam beads. The use of gas bubbles or gassing agents is less desirable because bubbles leak and coalesce during the storage of the explosive and thus decrease the detonation sensitivity. Another disadvantage is that under hydrostatic pressure the gas bubbles provide less effective density control which affects detonation sensitivity and performance.

Use of density control agents such as expanded perlite have been known in the emulsion explosive industry for many years. For example, such density control agents are described in Wade's U.S. Pat. No. 3,715,247. Additionally, patents exist on use of specific sizes of perlites such as preferred particle size ranges when used in explosive compositions, e.g., Sudweeks, et al., U.S. Pat. No. 4,231,821. The widespread current commercial practice is to use hollow glass microspheres (e.g., as provided by 3M or PQ) for emulsions which will be stored and/or handled in a bulk form, e.g., multiple pumping. Glass microspheres are different from perlites. A major difference is that the perlites are by nature porous, whereas hollow glass microspheres are nonporous. This difference in physical structure has caused the use of perlites to be limited. This is because a porous particle cannot maintain adequate density control of the final emulsion explosive product over time. In particular, pumping and other forms of applied work/pressure will cause irreversible density rise, leading to reduced performance of the explosive composition. Thus, it is desirable to use a density control agent which is not adversely affected by typical product handling, such as, shipping and pumping, or product application, i.e. use in wet boreholes where hydrostatic head pressure exist. Furthermore, with present-day perlites, density control over long periods of storage is not possible. With conventional perlites, density control is not maintained when the explosive product is subjected to agitation or shaking resulting from over-the-road handling of the product in bulk containers where this vibration and movement of the emulsion explosive can impart work on it. Where conventional perlites are used, density rise is found and continues to worsen with time. Furthermore, there has previously been an unacceptable viscosity rise which adversely affects handling, specifically pumping.

An expanded perlite has been discovered which imparts desirable features and technical advantages to emulsion explosives. Specific desirable features which the expanded perlite imparts on emulsion explosive compositions are as follows: (1) density control is maintained following multiple pumping of hot or cold emulsions containing the new perlites; (2) density control is maintained following exposure of the emulsion containing the new perlites to over-the-road handling with minimum viscosity rise of product during test; (3) detonation performance is attained in 4 inch diameter borehole when exposed to hydrostatic pressure using unpumped or pumped expanded perlite samples with detonation velocities in the cartridge-to-cartridge pressure bomb test of at least 6,000 ft/sec and preferably 15,000–16,000 ft/sec; and (4) detonation performance is attained in 3 inch diameter borehole at ambient pressure with reduced temperature when carried out on unpumped or on multiple pumped explosive products with detonation velocity in the cartridge-to-cartridge test of at least 6,000 ft/sec and preferably 15,000–16,000 ft/sec.

SUMMARY OF THE INVENTION

The invention provides a water-in-oil emulsion explosive composition containing a gas-retaining agent that permits density control upon handling, use, aging, and pumping.

In accordance with the present invention, an emulsion explosive composition comprising a continuous phase of carbonaceous fuel, an emulsifier, a dispersed phase of an aqueous solution of inorganic oxidizer, and a void-providing agent is provided.

In accordance with the present invention, an emulsion explosive composition having expanded perlite as the void-providing agent or as a portion of the void-providing agent is disclosed. The perlite used in the present invention is characterized by a density of 0.60 g/cc or less and preferably within the range of from about 0.1 g/cc to about 0.5 g/cc and more preferably 0.23 g/cc to about 0.45 g/cc. Furthermore, in accordance with the present invention is provided an emulsion explosive composition which maintains density control following multiple pumpings or storage while maintaining desired explosive qualities.

DETAILED DESCRIPTION

The explosive emulsion of the present application comprises: a continuous phase consisting of a carbonaceous fuel component, and an emulsifier; a dispersed phase consisting of an aqueous solution of inorganic oxidizer salt(s); and a void-providing agent(s).

The aqueous solution of the dispersed phase consists of an inorganic oxidizer salt(s) which consists totally or principally of ammonium nitrate and which can contain other inorganic oxidizer salts as known in the industry. For example, in addition to ammonium nitrate, the aqueous solution of inorganic oxidizer salts can also include nitrates of alkali metals or alkaline earth metals, chlorates, perchlorates, etc. Ammonium nitrate should be present at 46 to 95% by weight based on the total weight of the resulting explosive composition. All percentages herein are weight percent unless otherwise indicated. If other oxidizer salts are used in combination with ammonium nitrate, these oxidizer salts should not be in an amount greater than 40% of the mixture of ammonium nitrate and the other inorganic oxidizer salts, such that total inorganic oxidizer salt in the aqueous phase of the emulsion is 46% to 95% of the emulsion.

In a preferred embodiment, the emulsion composition comprises about 76% oxidizer salt which is ammonium nitrate.

The amount of water present to form the aqueous inorganic oxidizer salt solution is generally in the range from about 5 to about 25%. Preferably, the composition comprises about 14 to about 20% water.

The continuous phase consists of a carbonaceous fuel component. The carbonaceous fuel component to be used in the practice of the present invention can consist of any hydrocarbon fuel known in the art, such as fuel oil and/or wax. Hydrocarbon fuel includes, for example, diesel fuel oil, paraffinic hydrocarbon, olefinic hydrocarbon, naphthenic hydrocarbon, aromatic hydrocarbon, gas oil, heavy oil, lubricant, liquid paraffin, etc. The wax includes microcrystalline waxes which are derived from petroleum, mineral waxes, animal wax, insect wax, etc. These carbonaceous fuels can be used alone or in admixture. Generally, the composition comprises about 1.0 to about 10% carbonaceous fuel. In a preferred embodiment, the composition comprises about 5% to about 10% carbonaceous fuel.

In addition to the carbonaceous fuel component, the continuous phase contains an emulsifier(s). The emulsifier to be used in the practice of the present invention includes any known emulsifier used in the industry to produce water-in-oil emulsion explosives. For example: fatty acid ester of sorbitan, mono-or diglyceride of fatty acid, polyglycol ether, oxazoline derivatives, imidazoline derivatives, alkali metal or alkaline earth metal salt of fatty acid, salts of hydrocarbyl-substituted carboxylic acid or anhydride, and derivatives of polyisobutenyl succinic anhydride. The emulsifiers can be used alone or in admixture. The composition generally comprises 0.1–10% emulsifier. Suitable emulsifiers are well known in the art and are described in many U.S. patents, such as U.S. Pat. Nos.3,449,978, 4,920,340 and 4,708,753.

The void-providing agent of the present invention consists solely or partially of expanded perlite having a density in the range of 0.6 g/cc or less. Expanded perlite is obtained by high temperature heating of a mineral which upon exposure to heat expands due to the presence of entrapped water. The void-providing agent of the present invention is believed to be less porous than heretofore known perlites and density control is maintained following multiple pumpings and/or agitation. Expanded perlites useful in the present invention have a nominal or true density as measured by an air comparison pycnometer in the range of 0.6 g/cc or less and more preferably from about 0.1 g/cc to about 0.5 g/cc and more preferably from about 0.23 g/cc to about 0.45 g/cc. Density can be measured by a Beckman Model 930 Air Comparison Pycnometer. The bulk density of the perlites used in the present invention is about 5 to 12 lbs/cu.ft. Bulk density is a physical measurement which includes air volume in the container used. In contrast, the nominal density does not include air volume between the particles.

The amount of expanded perlite present in the resulting explosive composition can range from about 0.5 to about 10%. Preferably, the composition comprises about 1.0 to about 3.0% expanded perlite. The amount of perlite used will depend upon the final density of the water-in-oil emulsion desired. Typically, such emulsion compositions are made to a density in the range of about 1.0 to about 1.34 g/cc.

Table IA shows data on emulsion explosive densities and viscosities, before and after testing simulating over the road handling. The test was carried out for 4 hours with one pint samples on a standard paint shaker. The densities and viscosities were monitored and compared to control samples. The emulsions in Tables 1A, II, III and IV were made from an emulsion having a continuous phase of 7 parts of petroleum based type oil having a viscosity of 38–43 S.U.S. at 100° F. (except that samples 274 and 297 were produced using a petroleum based type-oil having a viscosity of 45–50 S.U.S. at 100° F.); and 1 part emulsifier which was a derivative of polyisobutenyl succinic anhydride; and a discontinuous phase of 76.4 parts of AN; and 15.6 parts $H_2O$. All parts recited are by weight. To this emulsion were added various amounts of perlite as indicated in the tables. The emulsions are identified by the perlite designation. Table V reports the characteristics of the perlites.

Referring to Table 1A, emulsions containing conventional perlites, HP212 and HP512, sold by Grefco, Inc., show immediate dramatic density and viscosity increases following the test whereas emulsion containing perlites of the present invention exhibit greater quality control, i.e., much smaller effect on density and viscosity. The conventional perlites of the examples, when measured with an air pycnometer, have a density above 0.8 g/cc. Other prior art perlites typically have a density in the range of 0.7 g/cc to 1.2 g/cc.

Table 1B shows further tests using an emulsion made as described above but utilizing an oil with a viscosity of 38–43 and the substitutes of a sorbitan monooleate emulsifier for the succinic anhydride emulsifier.

Table II illustrates the detonation results in pressure bomb tests of compositions by emulsions of Table 1A. The bomb test simulates hydrostatic pressure of 30 psi for 6 hours. Samples were detonated in confinement and under pressure. The samples of unpumped and pumped emulsion explosive compositions are shown to illustrate the dramatic improvement obtained in detonation sensitivity under pressure when using the new perlites, even after multiple pumping. The diameter in no way indicates the useful limit of the product and is simply for comparison. Samples were pumped by a positive displacement pump through a hose 2 inches in diameter and 25 feet in length. For repeating pumping the samples were pumped into a barrel and repumped into another barrel.

Table III shows detonation results and low temperature sensitivity tests of the compositions made in accordance with those of Table 1A. Velocity of detonation of the second cartridge was measured on 3 inch diameter unconfined samples which are shot cartridge-to-cartridge at reduced temperatures. The charge length was 10 inches or more. This test demonstrates both low temperature and propagation sensitivity.

Table IV shows densities of compositions made as by the emulsion of Table 1A in response to pumping. It is obvious that significant density rise occurs immediately upon pumping the conventional perlites such as HP212. The new perlite shows good density control even upon multiple pumpings. In fact, density decrease is noted. This indicates the capability of these perlites to assist in air-entrapment, a further advantage. This is supported by the density response of several of the new perlite containing products to the shaker test where a density decrease is noted. This has heretofore been unheard of, either with conventional perlites, glass microspheres, plastic microspheres, floated fly ash, and/or other density reducing agents commonly known in the industry.

Table V shows the characteristics of the new perlite. The reduced air pycnometer values are indicative of the reduction in porosity of the new perlites.

TABLE IA

| | | Emulsion Before shaking | | Emulsion After shaking | | Aged Emulsion Viscosity 1 Month** | |
|---|---|---|---|---|---|---|---|
| | Weight %* | Density (g/cc) | Viscosity (cps) | Density (g/cc) | Viscosity (cps) | U (cps) | S (cps) |
| Prior Art Sample | | | | | | | |
| HP212 | 1.20 | 1.240 | 45,000 | — | 63,000 | 53,000 | 70,000 |
| HP212 | 1.75 | 1.215 | 46,000 | 1.265 | 81,000 | 62,000 | 86,000 |
| HP512 | 3.20 | 1.215 | 59,000 | 1.240 | 74,000 | 75,000 | 102,000 |
| New Perlites | | | | | | | |
| 118-I | 2.30 | 1.235 | 55,000 | 1.255 | 56,000 | 57,000 | 66,000 |
| 118-II | 2.40 | 1.225 | 46,000 | 1.255 | 52,000 | 50,000 | 58,000 |
| 187 | 2.00 | 1.230 | 54,000 | 1.240 | 52,000 | 55,000 | 61,000 |
| 225 | 2.60 | 1.220 | 37,000 | 1.210 | 46,000 | 46,000 | 62,000 |
| 224 | 2.60 | 1.240 | 35,000 | 1.215 | 46,000 | 42,000 | 61,000 |
| 253 | 2.40 | 1.220 | 37,000 | 1.210 | 50,000 | 49,000 | 79,000 |
| 223 | 2.70 | — | 57,000 | 1.270 | 68,000 | 66,000 | 77,000 |
| 294 | 2.40 | 1.240 | 47,000 | 1.220 (108 deg. F.) | 45,000 | 53,000 | 57,000 |

Average Density Rise on New Perlites is approximately 0 (not including 223).
Average Viscosity Rise on New Perlites: Approximately 6,000 cps.
*Percent perlite added to emulsion
**U = Unshaken S = Shaken

TABLE IB

| | | Emulsion Before shaking | | Emulsion After Shaking | |
|---|---|---|---|---|---|
| | Weight %* | Density (g/cc) | Viscosity (cps) | Density (g/cc) | Viscosity (cps) |
| Prior Art Sample | | | | | |
| HP212 | 1.2 | 1.25 | 47,000 | 1.26 | 57,000 |
| New Perlites | | | | | |
| 253 | 2.4 | 1.23 | 45,000 | 1.24 | 59,000 |

TABLE IB-continued

| | | Emulsion Before shaking | | Emulsion After Shaking | |
|---|---|---|---|---|---|
| | Weight %* | Density (g/cc) | Viscosity (cps) | Density (g/cc) | Viscosity (cps) |
| 254 | 2.4 | 1.23 | 46,000 | 1.225 | 57,000 |

*Percent perlite added to emulsion.

TABLE II

PRESSURE BOMB TESTS
(Velocity of Detonation in feet per second)

| Prior Art Sample | Condition* | Diameter** | VOD*** |
|---|---|---|---|
| HP212 | Unpumped | 4" | 8,590; F |
| | | | F; F |
| | | 5" | 11,905 |
| HP512 | Unpumped | 4" | 9,805; 5,320 |
| | | 5" | 8,065; F |
| **New Perlite Sample** | **Condition** | **Diameter** | **VOD** |
| 224 | Unpumped | 4" | 16,130; 15,150 |
| | Pumped 4 times at ambient temperature | 4" | 15,150: 17,240 |
| | | 5" | 15,150; 16,670 |
| 225 | Unpumped | 4" | 15,150; 16,130 |
| | Pumped 4 times at ambient temperature | 4" | 16,130; 17,240 |
| | | 5" | 15,625; 15,150 |
| 253 | Pumped 4 times at ambient temperature | 4" | 15,625; 16,130 |
| | | 5" | 17,240; 16.660 |
| 274 | Pumped 4 times at elevated temperature | 4" | 17,860; 16,130 |

*Ambient temperature in the range of 65° F. to 85° F., elevated temperature in the range of about 140° to 212° F.
**Diameter of charge tested, charge length was at least 3 times the diameter.
***VOD is velocity of detonation reported in feet per second, and F indicates failure.

TABLE III

| Prior[1] Art Sample | Condition[2] | Detonation Tests[3] 1 Week | 1 Month | 2 Months | 3 Months |
|---|---|---|---|---|---|
| HP212 (1.2%) | Unpumped | 70 deg-17,240<br>0 deg-Failed | 70 deg-13,150<br>20 deg-8,620<br>40 deg-11,905 | 70 deg-14,705<br>20 deg-Failed | 70 deg-12,820<br>40 deg-5,210 |

TABLE III-continued

| | | | | | |
|---|---|---|---|---|---|
| HP212 (1.4%) | Pumped 4 Times Hot | 70 deg-10,640<br>0 deg-Failed | 70 deg-8,620<br>40 deg-6,330 | — | |
| HP212 (1.4%) | Pumped 4 Times Ambient | 70 deg-18,240<br>0 deg-Failed<br>20 deg-Failed<br>40 deg-4,950 | 70 deg-11,905<br>40 deg-Failed | — | |
| HP212 (1.75%) | Pumped 4 Times Hot | 70 deg-10,870<br>0 deg-Failed | 70 deg-12,500<br>40 deg-2,605 | — | |
| HP212 (1.75%) | Unpumped | 70 deg-17,860<br>0 deg-14,705 | 70 deg-15,625<br>0 deg-11,625 | 70 deg-17,860<br>0 deg-13,515 | 70 deg-16,670<br>0 deg-14,285 |
| HP212 (1.75%) | Pumped 2 Times Ambient | 70 deg-14,705<br>10 deg-Failed<br>20 deg-Failed<br>40 deg-10,205 | 70 deg-12,500 | 70 deg-13,890<br>40 deg-8,475 | — |
| HP212 (1.75%) | Pumped 4 Times Ambient | 70 deg-12,500<br>20 deg-Failed<br>40 deg-Failed | | — | |
| HP512 (3.2%) | Unpumped | 70 deg-19,605<br>0 deg-12,820 | —<br>— | 70 deg-17,545<br>0 deg-11,625 | 70 deg-13,890<br>0 deg-6,670 |
| New Perlite Sample | Condition | 1 Week | 1 Month | 2 Months | 3 Months |
| 224 (2.6%) | Unpumped | 0 deg-13,890 | | — | |
| 224 (2.6%) | Pumped 4 Times Ambient | 70 deg-15,625<br>0 deg-13,515 | 70 deg-15,150<br>0 deg-12,195 | 70 deg-14,285<br>0 deg-11,905 | 70 deg-13,890<br>0 deg-15,150 |
| 225 (2.6%) | Unpumped | 0 deg-13,155 | — | | |
| 225 (2.6%) | Pumped 4 Times Ambient | 70 deg-14,705<br>0 deg-13,890 | 70 deg-15,875<br>0 deg-13,890 | 70 deg-15,875<br>0 deg-11,905 | 70 deg-12,820<br>0 deg-11,110 |
| 253 (2.4%) | Unpumped | 0 deg-12,195 | — | | |
| 253 (2.4%) | Pumped 4 Times Ambient | 70 deg-14,490<br>0 deg-14,285 | 70 deg-14,705<br>0 deg-12,500 | 70 deg-14,705<br>0 deg-9,800 | |
| 274 (2.4%) | Pumped 4 Times Hot | 70 deg-15,150<br>0 deg-12,820 | 70 deg-15,625<br>0 deg-13,160 | | |

[1]Weight percent of perlite used in emulsion reported in parenthesis.
[2]Umpumped indicates sample not pumped. Pumped 4 times hot indicates sample was pumped immediately after making at a temperature from 60° C. to 100° C., and repumped immediately, thus some temperature decrease occurred because the sample was not reheated after each pumping. Pumped ambient indicates the emulsion was allowed to cool to about 20° C. before being pumped.
[3]Samples of the unpumped material or of the material after the indicated number of pumpings were stored for the designated periods. Samples were then tested for detonability at the indicated temperature (°F.). Velocity reported in feet/second.

TABLE IV

| Prior Art Sample | Condition[1] | Hot Densities g/cc[2] | Room Temperature Densities g/cc[2] |
|---|---|---|---|
| HP212 | Pumped 4 Times Hot | Before-1.20<br>After-1.25 | After-1.27 |
| | Pumped 4 Times Ambient | — | Before-1.235<br>After-1.25 |
| | Pumped 2 Times Ambient | — | Before-1.195<br>After-1.24 |
| | Pumped 4 Times Ambient | — | Before-1.195<br>After-1.26 |

| New Perlite Sample | Number of Times Pumped | Age[3] | Emulsion Density g/cc |
|---|---|---|---|
| 224 | 0 | Fresh | 1.230 |
| | 1 | Fresh | 1.210 |
| | 2 | Fresh | 1.200 |
| | | 3 Weeks | 1.220 |
| | | 10 Weeks | 1.235 |
| | 3 | Fresh | 1.195 |
| | | 3 Weeks | 1.225 |
| | | 10 Weeks | 1.240 |
| | 4 | Fresh | 1.195 |
| | | 1 Week | 1.225 |
| | | 3 Weeks | 1.235 |
| | | 10 Weeks | 1.245 |
| 225 | 0 | Fresh | 1.220 |
| | 1 | Fresh | 1.200 |
| | 2 | Fresh | 1.190 |
| | | 3 Weeks | 1.210 |
| | | 9 Weeks | 1.220 |
| | 3 | Fresh | 1.190 |
| | | 3 Weeks | 1.210 |

TABLE IV-continued

| | | | |
|---|---|---|---|
| | | 9 Weeks | 1.220 |
| | 4 | Fresh | 1.195 |
| | | 1 Week | 1.210 |
| | | 3 Weeks | 1.215 |
| | | 9 Weeks | 1.220 |
| 253 | 0 | Fresh | 1.210 |
| | 1 | Fresh | 1.210 |
| | | 4 Weeks | 1.210 |
| | | 11 Weeks | 1.225 |
| | 2 | Fresh | 1.195 |
| | | 4 Weeks | 1.205 |
| | | 11 Weeks | 1.225 |
| | 3 | Fresh | 1.195 |
| | | 4 Weeks | 1.205 |
| | | 11 Weeks | 1.215 |

| New Perlite Sample | Number of Times Pumped | Age[3] | Emulsion Density g/cc/ Temperature (°F.) |
|---|---|---|---|
| 253 | 4 | Fresh | 1.195 |
| | | 4 Weeks | 1.205 |
| | | 11 Weeks | 1.225 |
| 274 | 0 | Fresh | 1.205/158 deg.<br>1.230/70 deg. |
| | | 8 Weeks | 1.235/77 deg. |
| | 1 | Fresh | 1.190/150 deg.<br>1.220/70 deg. |
| | | 8 Weeks | 1.225/77 deg. |
| | 2 | Fresh | 1.190/143 deg.<br>1.215/70 deg. |
| | | 8 Weeks | 1.220/77 deg. |
| | 3 | Fresh | 1.190/140 deg.<br>1.215/70 deg. |
| | | 8 Weeks | 1.215/77 deg. |

TABLE IV-continued

| | | |
|---|---|---|
| | | Sample 1 |
| 4 | Fresh | 1.190/132 deg. |
| | | 1.215/70 deg. |
| | 8 Weeks | 1.220/77 deg. |
| | | Sample 2 |
| 4 | Fresh | 1.200/133 deg. |
| | | 1.220/70 deg. |
| | 8 Weeks | 1.230/77 deg. |

[1]See description in footnote 2, Table III.
[2]"Before" is the density measurement before first pumping. "After" is the density measured after the indicated number of pumpings.
[3]Age is for products which were pumped the indicated number of times before storage.

TABLE V

| | Art Pycnometer* (g/cc) | Bulk (lbs/cu foot) | DENSITIES U.S. Standard Sieve +50 | −50 +100 | −100 +200 | −200 +325 | −325 |
|---|---|---|---|---|---|---|---|
| Prior Art Sample | | | | | | | |
| HP212 | (0.8–1.2) | 5 | 15.0 | 37.6 | 32.0 | 9.0 | 6.0 |
| HP512 | 1 (0.82–1.0) | 7.4 | | | | | |
| New Perlite Sample | | | | | | | |
| 118-1 | — (0.352) | — | 11.9 | 38.5 | 38.9 | 10.7 | 0.8 |
| 118-11 | — (0.355) | — | 11.6 | 52.4 | 36.0 | — | — |
| 187 | 0.28 (0.28) | 7.7 | 11.4 | 38.8 | 38.1 | 11.8 | — |
| 223 | 0.42 (0.418) | 10.6 | 7.6 | 25.3 | 33.3 | 10.5 | 23.2 |
| 224 | 0.34 — | 8.0 | 16.7 | 42.4 | 32.4 | 7.1 | 1.4 |
| 225 | 0.30 (0.306) | 8.8 | 8.0 | 32.5 | 38.2 | 14.5 | 6.8 |
| 253** | 0.33 (0.32) | 7.9 | 10.4 | 34.6 | 37.3 | 14.1 | 3.6 |
| 274 | 0.31 (0.315) | 8.6 | 11.7 | 35.5 | 35.5 | 13.7 | 3.6 |
| 294 | 0.31 (0.295) | 8.5 | | Reportedly same as 274 | | | |

*First value was provided by supplier; values in parentheses were measured values with an air comparison pycnometer.
**This sample was not free flowing - seemed almost "damp".

The water-in-oil emulsion explosive composition of the present invention can be produced in the following manner. (1) Ammonium nitrate (or in combination with other inorganic solid oxidizer salts) is dissolved in water at a temperature of about 60°–100° C. (140° F. to 212° F.) to form an aqueous solution of inorganic oxidizer salt. Next, an emulsifier is added to the carbonaceous fuel component and heated to form the continuous phase. The emulsifier and carbonaceous fuel are mixed and heated to about 40° to about 80° C. (104° F. to 176° F.). The aqueous solution of inorganic oxidizer salt is then slowly added to the fuel and emulsifier admixture with agitation maintaining a temperature of about 60° to about 100° C. After the two phases are mixed, the gas-retaining agent of expanded perlite, alone or in combination with other known gas-retaining agents, is added to the admixture to form the emulsion explosive composition of the present invention.

The emulsion of the present invention can also be admixed with particulate ammonium nitrate or ANFO. ANFO is a mixture of ammonium nitrate prills with diesel fuel oil. An oxygen balanced ANFO is about 94% ammonium nitrate and 6% fuel. ANFO compositions usually are mixed such that the ANFO is within plus or minus 10% of an oxygen balanced mixture. When a particulate ammonium nitrate is added, the fuel phase of the emulsion contains additional oil in the amount which will approximately oxygen balance the amount of particulate ammonium nitrate added. Such mixtures of ammonium nitrate with the emulsion of the present invention contain 10% or more emulsion with 90% or less particulate ammonium nitrate or ANFO. Preferably, such mixtures contain about 50% or more emulsion with about 50% or less particulate ammonium nitrate or ANFO.

Having described specific embodiments of the present invention, it will be understood that modification thereof may be suggested to those skilled in the art, and it is intended to cover all such modifications as fall within the scope of the appended claims.

I claim:

1. A water-in-oil emulsion explosive composition comprising:

a continuous phase consisting of a carbonaceous fuel component and emulsifier;

a dispersed phase consisting of an aqueous solution of inorganic oxidizer salt(s); and a void-providing agent consisting of expanded perlite having a density of less than 0.60 g/cc.

2. The water-in-oil emulsion explosive composition of claim 1, wherein the continuous carbonaceous fuel component consists of one of the following selected from the group of diesel fuel oil, paraffinic hydrocarbon, olefinic hydrocarbon, naphthenic hydrocarbon, aromatic hydrocarbon, gas oil, heavy oil, lubricant, or liquid paraffin.

3. The water-in-oil emulsion explosive composition of claim 1, wherein the emulsifier of the continuous phase consists of one of the following selected from the group of fatty acid ester of sorbitan, mono- or diglyceride of fatty acid, polyglycol ether, oxazoline derivatives, imidozoline derivatives, alkali metal or alkaline earth metal salt of fatty acid, salts of hydrocarbyl-substituted carboxylic acid or anhydride, and derivatives of polyisobutenyl succinic anhydride.

4. The water-in-oil emulsion explosive composition of claim 1, wherein the inorganic oxidizer salt solution of the dispersed phase consists of at least one of the following selected from the group of ammonium nitrate, nitrates of alkali metals, nitrates of alkaline earth metals, chlorates or perchlorates.

5. The water-in-oil emulsion explosive composition of claim 4, wherein the inorganic oxidizer salt solution of the dispersed phase consists of from about 5–25% water.

6. The water-in-oil emulsion explosive composition of claim 1, further comprising one or more additional void-providing agents selected from the group consisting of entrained gas bubbles, chemical gassing agents, expanded perlite at a density above 0.7 g/cc, phenol-formaldehyde, urea-formaldehyde, hollow microspheres, or hollow glass microspheres, and styrofoam beads.

7. A water-in-oil emulsion explosive composition comprising:

a continuous phases consisting of from about 1.0 to about 10.0% carbonaceous fuel component and emulsifier;

a dispersed phase consisting of an aqueous solution of from about 5 to about 25% water;

a dispersed phase consisting of from about 46 to 95% inorganic oxidizer salt(s); and a void-providing agent consisting of 0.5–10% expanded perlite having a density of less than 0.60 g/cc.

8. The water-in-oil emulsion explosive composition of claim 7, wherein the continuous carbonaceous fuel component consists of one of the following selected from the group of diesel fuel oil, paraffinic hydrocarbon, olefinic hydrocarbon, naphthenic hydrocarbon, aromatic hydrocarbon, gas oil, heavy oil, lubricant, or liquid paraffin.

9. The water-in-oil emulsion explosive composition of claim 7, wherein the emulsifier of the continuous phase consists of one of the following selected from the group of fatty acid ester of sorbitan, mono- or diglyceride of fatty acid, polyglycol ether, oxazoline derivatives, imidozoline derivatives, alkali metal or alkaline earth metal salt of fatty acid, salts of hydrocarbyl-substituted carboxylic acid or anhydride, and derivatives of polyisobutenyl succinic anhydride.

10. The water-in-oil emulsion explosive composition of claim 7, wherein the inorganic oxidizer salt solution of the dispersed phase consists of at least one of the following selected from the group of ammonium nitrate, nitrates of alkali metals, nitrates of alkaline earth metals, chlorates or perchlorates.

11. The water-in-oil emulsion explosive composition of claim 10, wherein the inorganic oxidizer salt solution of the dispersed phase consists of from about 6 to about 20% water.

12. The water-in-oil emulsion explosive composition of claim 7, further comprising one or more additional void-providing agents selected from the group consisting of entrained gas bubbles, chemical gassing agents, expanded perlite at a density above 0.8 g/cc, phenol-formaldehyde, urea-formaldehyde, hollow microspheres, or hollow glass microspheres, and styrofoam beads.

13. A water-in-oil emulsion explosive composition comprising:

a continuous phases consisting from about 1.0 to about 10.0% carbonaceous fuel component and emulsifier;

a dispersed phase consisting of from about 5 to about 25% water;

a dispersed phase consisting of from about 46 to 95% inorganic oxidizer salt(s); and a void-providing agent consisting of from about 0.5 to about 3.0% expanded perlite having a density of from about 0.23 g/cc to about 0.45 g/cc.

14. The water-in-oil emulsion explosive composition of claim 13, wherein the continuous carbonaceous fuel component consists of one of the following selected from the group of diesel fuel oil, paraffinic hydrocarbon, olefinic hydrocarbon, naphthenic hydrocarbon, aromatic hydrocarbon, gas oil, heavy oil, lubricant, or liquid paraffin.

15. The water-in-oil emulsion explosive composition of claim 13, wherein the emulsifier of the continuous phase consists of one of the following selected from the group of fatty acid ester of sorbitan, mono- or diglyceride of fatty acid, polyglycol ether, oxazoline derivatives, imidozoline derivatives, alkali metal or alkaline earth metal salt of fatty acid, salts of hydrocarbyl-substituted carboxylic acid or anhydride, and derivatives of polyisobutenyl succinic anhydride.

16. The water-in-oil emulsion explosive composition of claim 13, wherein the inorganic oxidizer salt solution of the dispersed phase consists of at least one of the following selected from the group of ammonium nitrate, nitrates of alkali metals, nitrates of alkaline earth metals, chlorates or perchlorates.

17. An explosive composition comprising:

(a) at least 50% of a water-in-oil emulsion comprising:

(i) a discontinuous aqueous phase of an inorganic salt solution;

(ii) a continuous carbonaceous fuel phase;

(iii) an emulsifier effective to form a water-in-oil emulsion; and (iv) expanded perlite having a density of 0.6 g/cc or less; and (b) 50% or less of a solid constituent being primarily an inorganic oxidizer salt.

18. The composition of claim 17, wherein said solid constituent is ammonium nitrate.

19. The composition of claim 17, wherein said solid constituent is a mixture of ammonium nitrate and fuel oil having an oxygen balance in the range of about +10% to about −10%.

20. An explosive composition comprising:

(a) at least 10% of a water-in-oil emulsion comprising:

(i) a discontinuous aqueous phase of an inorganic salt solution;

(ii) a continuous carbonaceous fuel phase;

(iii) an emulsifier effective to form a water-in-oil emulsion; and (iv) expanded perlite having a density of 0.6 g/cc or less; and (b) 90% or less of a solid constituent being primarily an inorganic oxidizer salt.

* * * * *

UNITED STATES PATENT AND TRADEMARK OFFICE

CERTIFICATE OF CORRECTION

PATENT NO. : 4,940,497

DATED : July 10, 1990

INVENTOR(S) : Van Ommeren

It is certified that error appears in the above-identified patent and that said Letters Patent is hereby corrected as shown below:

Column 1, line 15, delete "explosive" and insert therefore --explosives--.

Column 1, line 29, after "smokeless powder" insert --,--.

Column 1, line 59, after "perlites" insert --,--.

Column 1, line 59, after "ranges" insert --,--.

Column 2, line 1, delete "limited. This is" and insert therefore --,--.

Column 2, line 8, delete "as," and insert therefore --as--.

Column 2, line 9, delete "pumping," and insert therefore --pumping--.

Column 2, line 9, after "i.e." insert --,--.

Column 2, line 10, delete "exist." and insert therefore --exists .--.

Column 2, line 16, delete "where" and insert therefore --upon which--.

Column 2, line 32, after "during" insert --the--.

Column 2, line 33, after "in" insert --a--.

Column 2, line 39, after "in" insert --a--.

Column 2, line 62, after 0.5 g/cc" insert --,--.

Column 3, line 16, after "46" insert --%--.

UNITED STATES PATENT AND TRADEMARK OFFICE

CERTIFICATE OF CORRECTION

PATENT NO. : 4,940, 497

DATED : July 10, 1990

INVENTOR(S) : Van Ommeren

It is certified that error appears in the above-identified patent and that said Letters Patent is hereby corrected as shown below:

Column 3, line 31, after "5" insert --%--.

Column 3, line 45, after "1.0" insert --%--.

Column 3, line 52, delete "example:" and insert therefore --example,--.

Column 3, line 58, after "anhydride" insert --are suitable emulsifiers--.

Column 3, line 60, delete "0.1-10%" and insert therefore --0.1% to 10%--.

Column 3, line 66, delete "high temperature" and insert therefore --high-temperature--.

Column 4, line 8, delete "more" and insert therefore --most--.

Column 4, line 17, after "0.5" insert --%--.

Column 4, line 19, after "1.0" insert --%--.

Column 4, line 54, after "38-43" insert --S.U.S.--.

Column 4, line 68, delete "repeating" and insert therefore --repeated--.

Column 5, line 7, delete "are" and insert therefore --were--.

UNITED STATES PATENT AND TRADEMARK OFFICE

CERTIFICATE OF CORRECTION

PATENT NO. : 4,940, 497

DATED : July 10, 1990

INVENTOR(S) : Van Ommeren

It is certified that error appears in the above-identified patent and that said Letters Patent is hereby corrected as shown below:

Column 9, line 38, delete "manner." and insert therefore --manner:--.

Column 9, line 45, after "40°" insert --C--.

Column 9, line 48, after "60°" insert --C--.

Column 9, line 57, delete "oxygen balanced" and insert therefore --oxygen-balanced--.

Column 9, line 63, delete "oxygen balance" and insert therefore --oxygen-balance--.

Column 11, line 6, delete "phases" and insert therefore --phase--.

Column 11, line 6, after "1.0" insert --%--.

Column 11, line 10, after "5" insert --%--.

Column 11, line 11, after "46" insert --%--.

Column 11, line 40, after "6" insert --%--.

Column 11, line 52, delete "phases" and insert therefore --phase--.

UNITED STATES PATENT AND TRADEMARK OFFICE

CERTIFICATE OF CORRECTION

PATENT NO. : 4,940,497

DATED : July 10, 1990

INVENTOR(S) : Van Ommeren

It is certified that error appears in the above-identified patent and that said Letters Patent is hereby corrected as shown below:

Column 11, line 52, after "1.0" insert --%--.

Column 11, line 55, after "5" insert --%--.

Column 12, line 1, after "46" insert --%--.

Column 12, line 3, after "0.5" insert --%--.

Signed and Sealed this

Twelfth Day of May, 1992

*Attest:*

DOUGLAS B. COMER

*Attesting Officer*

*Acting Commissioner of Patents and Trademarks*